US010202852B2

(12) United States Patent
Jaiswal et al.

(10) Patent No.: US 10,202,852 B2
(45) Date of Patent: Feb. 12, 2019

(54) ROTOR BLADE WITH TIP SHROUD COOLING PASSAGES AND METHOD OF MAKING SAME

(71) Applicant: General Electric Company, Schenectady, NY (US)

(72) Inventors: Shashwat Swami Jaiswal, Karnataka (IN); Rohit Chouhan, Karnataka (IN)

(73) Assignee: General Electric Company, Schenectady, NY (US)

( * ) Notice: Subject to any disclaimer, the term of this patent is extended or adjusted under 35 U.S.C. 154(b) by 464 days.

(21) Appl. No.: 14/942,350

(22) Filed: Nov. 16, 2015

(65) Prior Publication Data

US 2017/0138203 A1 May 18, 2017

(51) Int. Cl.
*F01D 5/18* (2006.01)
*F01D 5/22* (2006.01)

(52) U.S. Cl.
CPC ..... *F01D 5/187* (2013.01); *F01D 5/186* (2013.01); *F01D 5/225* (2013.01); *F05D 2220/30* (2013.01); *F05D 2230/10* (2013.01); *F05D 2230/60* (2013.01); *F05D 2240/30* (2013.01); *F05D 2260/202* (2013.01)

(58) Field of Classification Search
CPC ..... F01D 5/186; F01D 5/187; F05D 2260/202
See application file for complete search history.

(56) References Cited

U.S. PATENT DOCUMENTS 3,606,574 A 9/1971 Brands et al.
5,350,277 A 9/1994 Jacala et al.
5,460,486 A 10/1995 Evans et al.
6,099,253 A * 8/2000 Fukue ..... F01D 5/187 416/191
6,499,950 B2 * 12/2002 Willett ..... F01D 5/182 416/97 R
6,761,534 B1 7/2004 Willett
(Continued)

FOREIGN PATENT DOCUMENTS

EP 1 253 291 A1 10/2002
GB 1 605 335 A 12/1991
GB 2 298 246 A 8/1996

OTHER PUBLICATIONS

Extended European Search Report and Opinion issued in connection with corresponding EP Application No. 16198571.8 dated Mar. 24, 2017.

*Primary Examiner* — Jason D Shanske
*Assistant Examiner* — Brian O Peters
(74) *Attorney, Agent, or Firm* — Armstrong Teasdale LLP

(57) ABSTRACT

A rotor blade includes an airfoil portion that extends in a radial direction from a root end to a tip end. A plurality of internal airfoil cooling passages is defined in the airfoil portion. The rotor blade also includes a tip shroud. The tip shroud includes a shroud plate coupled to the tip end. A plurality of tip shroud cooling passages is defined within the shroud plate. Each of the tip shroud cooling passages extends within the shroud plate in a direction generally transverse to the radial direction. Each tip shroud passage includes an inlet coupled in flow communication with at least one of the airfoil cooling passages, and an exit opening defined in, and extending therethrough, a radially outer surface of the tip shroud. The exit opening is coupled in flow communication with the inlet.

18 Claims, 7 Drawing Sheets

(56) References Cited

U.S. PATENT DOCUMENTS

| | | | | |
|---|---|---|---|---|
| 7,568,882 | B2 | 8/2009 | Brittingham et al. | |
| 7,946,816 | B2 | 5/2011 | Brittingham | |
| 8,057,177 | B2 | 11/2011 | Brittingham | |
| 8,313,301 | B2 | 11/2012 | Hudson | |
| 8,322,986 | B2 * | 12/2012 | DeSander | F01D 5/187 416/96 R |
| 8,485,787 | B2 * | 7/2013 | Marra | B21C 23/085 29/889.72 |
| 9,371,741 | B2 * | 6/2016 | Ito | F01D 5/187 |
| 2011/0058949 | A1 * | 3/2011 | Marra | B21C 23/085 416/233 |
| 2013/0142649 | A1 | 6/2013 | Collier et al. | |
| 2013/0142667 | A1 * | 6/2013 | Ito | F01D 25/12 416/97 R |
| 2018/0179900 | A1 * | 6/2018 | Tham | F01D 5/225 |

* cited by examiner

ROTOR BLADE WITH TIP SHROUD COOLING PASSAGES AND METHOD OF MAKING SAME

BACKGROUND

The field of the disclosure relates generally to rotor blades for rotary machines, and more particularly to a rotor blade having cooling passages defined in a tip shroud of the blade.

At least some known rotor blades include tip shrouds. For example, the tip shrouds improve an aerodynamic performance of the rotor blades. In addition, at least some known rotor blades are subject to wear and/or damage from exposure to hot gases in a hot gas path of a rotary machine. Thus, at least some known rotor blades include a plenum defined in the tip shroud, and cooling fluid is supplied to the plenum and exhausted through a peripheral edge of the tip shroud during operation of the rotary machine to cool the tip shroud and/or other portions of the rotor blade near the tip shroud. However, for at least some known rotor blades, diversion of the cooling fluid internally through the periphery of the tip shroud reduces an amount of cooling fluid available for film and/or convection cooling of a radially outer surface of the tip shroud.

Moreover, an amount of cooling needed varies for different regions on or proximate the tip shroud, and an amount of cooling fluid supplied to the plenum is selected to accommodate the portion with the greatest cooling needs. For at least some known rotary machines, supplying a larger amount of cooling fluid to the rotor blade simultaneously decreases an efficiency of the rotary machine. Alternatively or additionally, to reduce an amount of cooling fluid needed for the tip shroud, at least some rotor blades are formed with an increased "scallop" of the tip shroud, such that a distance that the tip shroud extends perpendicular to an airfoil of the rotor blade is decreased. However, for at least some rotary machines, increasing the scallop of the tip shroud also reduces an aerodynamic effectiveness of the tip shroud, thereby decreasing an efficiency of the rotary machine.

BRIEF DESCRIPTION

In one aspect, a rotor blade is provided. The rotor blade includes an airfoil portion that extends in a radial direction from a root end to a tip end. A plurality of internal airfoil cooling passages is defined in the airfoil portion. The rotor blade also includes a tip shroud. The tip shroud includes a shroud plate coupled to the tip end. A plurality of tip shroud cooling passages is defined within the shroud plate. Each of the tip shroud cooling passages extends within the shroud plate in a direction generally transverse to the radial direction. Each tip shroud passage includes an inlet coupled in flow communication with at least one of the airfoil cooling passages, and an exit opening defined in, and extending therethrough, a radially outer surface of the tip shroud. The exit opening is coupled in flow communication with the inlet.

In another aspect, a rotary machine is provided. The rotary machine includes a turbine section that includes a plurality of rotor blades. At least one of the rotor blades includes an airfoil portion that extends in a radial direction from a root end to a tip end. A plurality of internal airfoil cooling passages is defined in the airfoil portion. The rotor blade also includes a tip shroud. The tip shroud includes a shroud plate coupled to the tip end. A plurality of tip shroud cooling passages is defined within the shroud plate. Each of the tip shroud cooling passages extends within the shroud plate in a direction generally transverse to the radial direction. Each tip shroud passage includes an inlet coupled in flow communication with at least one of the airfoil cooling passages, and an exit opening defined in, and extending therethrough, a radially outer surface of the tip shroud. The exit opening is coupled in flow communication with the inlet.

In another aspect, a method of forming a rotor blade is provided. The method includes forming a plurality of internal airfoil cooling passages in an airfoil portion. The airfoil portion extends in a radial direction from a root end to a tip end. The method also includes forming a plurality of tip shroud cooling passages within a shroud plate of a tip shroud, and coupling the shroud plate to the tip end of the airfoil portion such that each of the tip shroud cooling passages extends within the shroud plate in a direction generally transverse to the radial direction. Each tip shroud passage includes an inlet coupled in flow communication with at least one of the airfoil cooling passages, and an exit opening defined in, and extending therethrough, a radially outer surface of the tip shroud. The exit opening is coupled in flow communication with the inlet.

DETAILED DESCRIPTION

The exemplary rotor blades and methods described herein overcome at least some of the disadvantages associated with known cooling arrangements for tip shrouds of rotor blades. The embodiments described herein provide internal airfoil cooling passages defined in a blade airfoil portion. A plurality of tip shroud cooling passages is in flow communication with the airfoil cooling passages. One or more of the tip shroud cooling passages are placed proximate regions of high thermal stress on or near the tip shroud, facilitating cooling of the regions of high thermal stress internally by the cooling fluid. In addition, the tip shroud cooling passages are provided with radial exit openings that exhaust the cooling fluid over a radially outer surface of the tip shroud, facilitating film and/or convection cooling of the surface of the tip shroud. In certain embodiments, a relative amount of cooling fluid supplied to each tip shroud cooling passage is determined by a width of the respective airfoil cooling passage in flow communication with that tip shroud cooling passage. Additionally, in some embodiments, at least one tip shroud cooling passage is defined by a cavity formed in a surface of a shroud plate and covered with a cover plate. In some such embodiments, the radial exit opening is defined in the cover plate.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Approximating language may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

Figure 1:
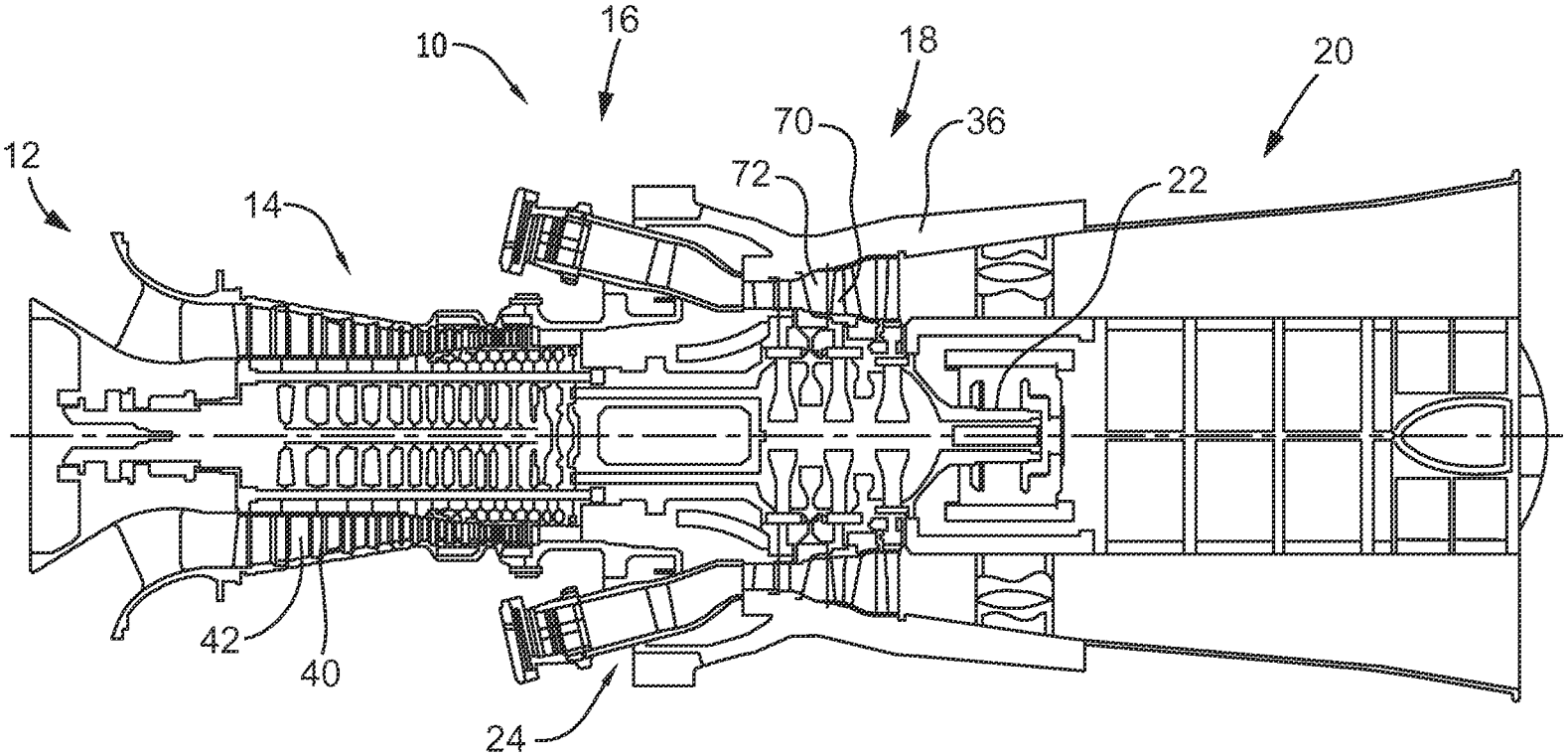
FIG. 1 is a schematic diagram of an exemplary embodiment of a rotary machine.

FIG. 1 is a schematic view of an exemplary rotary machine 10 with which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any machine having rotor blades for which the embodiments of the current disclosure are enabled to function as described herein.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of gas turbine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 in a hot gas path of rotary machine 10, such as, but not limited to, rotor blades 70, are subject to wear and/or damage from exposure to the high temperature gases.

Figure 2:
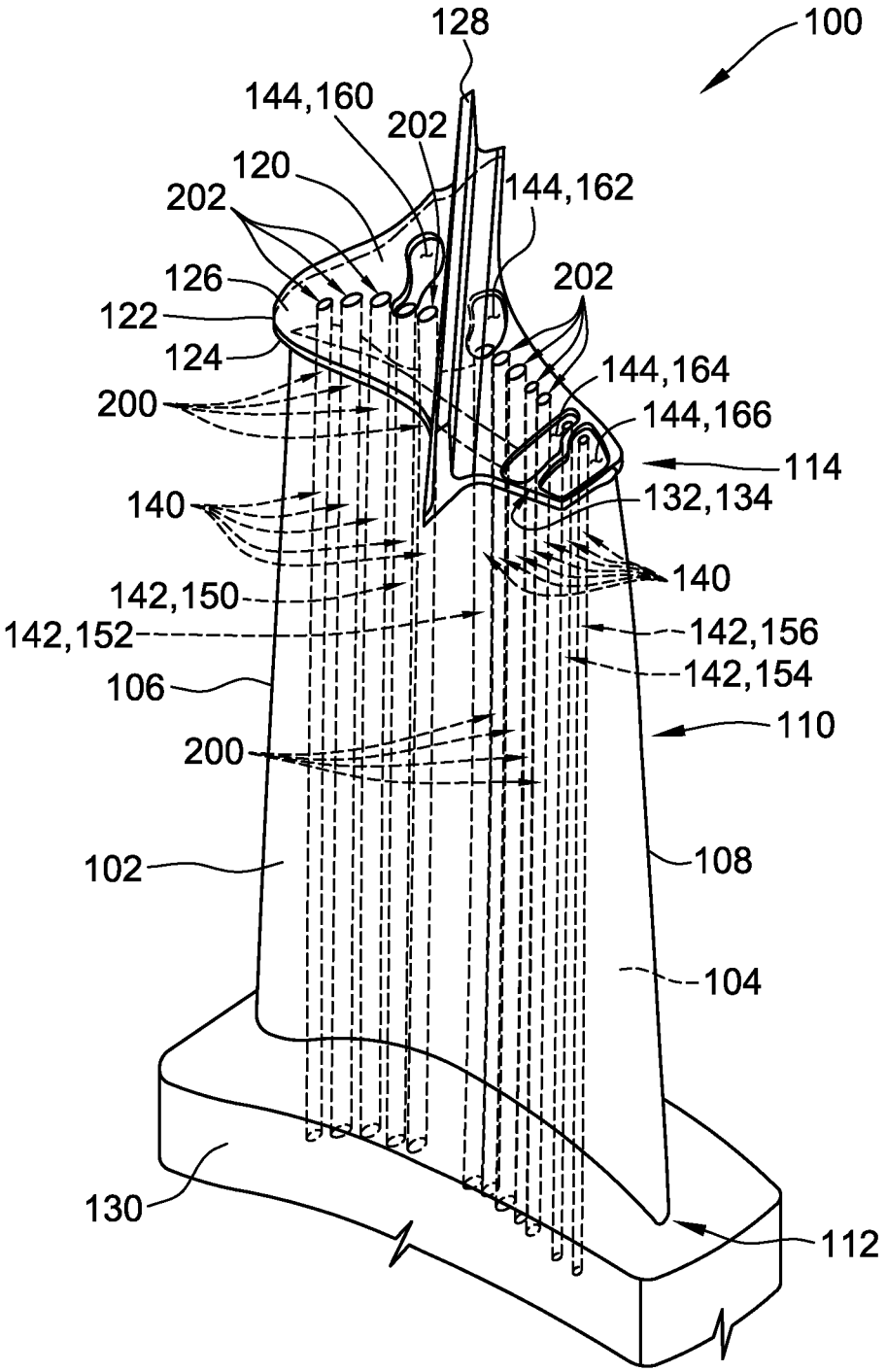
FIG. 2 is a schematic perspective view of an exemplary rotor blade for use with a rotary machine, such as the exemplary rotary machine shown in FIG. 1.
Figure 3:
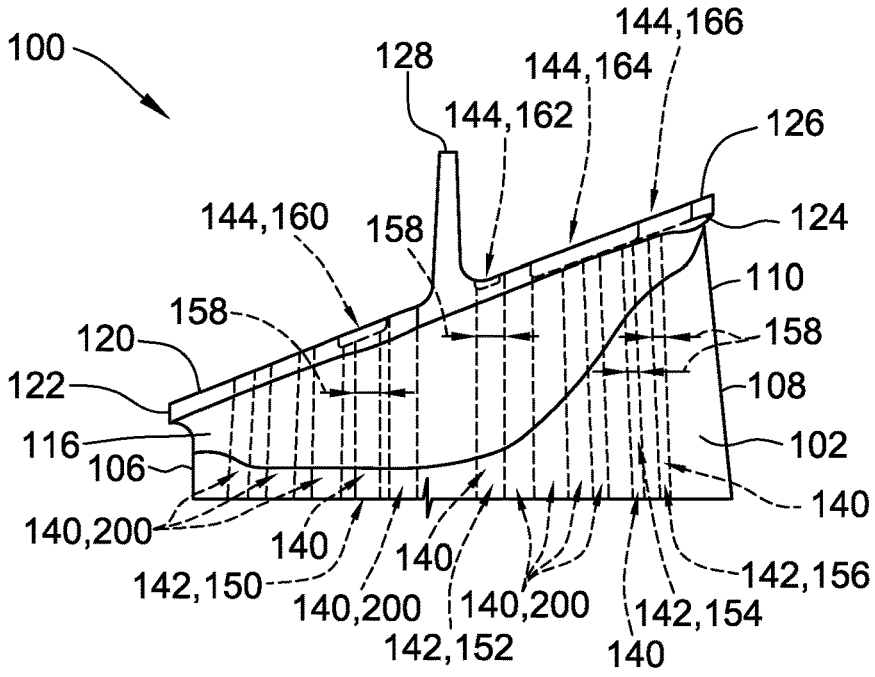
FIG. 3 is a schematic side view of a pressure side of a portion of the exemplary rotor blade shown in FIG. 2.
Figure 4:
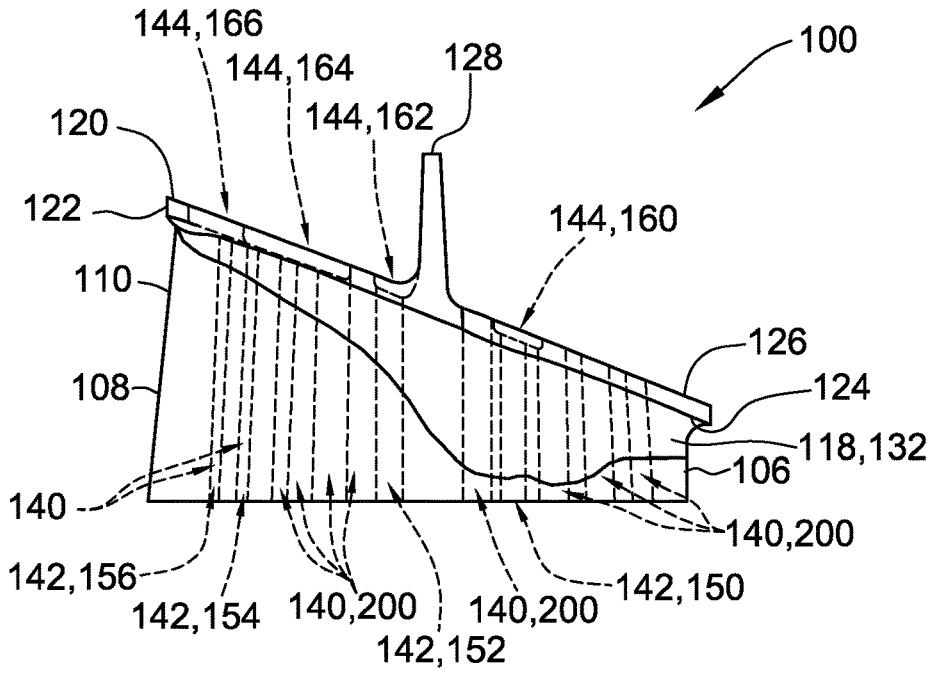
FIG. 4 is a schematic side view of a suction side of a portion of the exemplary rotor blade shown in FIG. 2.

FIG. 2 is a schematic perspective view of an exemplary rotor blade 100 for use with rotary machine 10. FIG. 3 is a schematic side view of a pressure side 102, and FIG. 4 is a schematic side view of a suction side 104, of a portion of rotor blade 100. For example, rotor blade 100 is used as one of rotor blades 70 (shown in FIG. 1).

With reference to FIGS. 2-4, in the exemplary embodiment, rotor blade 100 includes an airfoil portion 110, a tip shroud 120, and a root portion 130. Airfoil portion 110 extends from pressure side 102 to suction side 104 opposite pressure side 102. Each of pressure side 102 and suction side 104 extends from a leading edge 106 to an opposite trailing edge 108. In addition, airfoil portion 110 extends generally in a radial direction 101 from a root end 112 to an opposite tip end 114. Root end 112 of airfoil portion 110 is coupled to root portion 130. Root portion 130 includes any suitable structure that enables rotor blade 100 to couple to rotor 22 (shown in FIG. 1), such as, but not limited to, a dovetail (not shown). In alternative embodiments, rotor blade 100 has any suitable configuration that is capable of being formed with tip shroud 120 as described herein.

Tip shroud 120 includes a shroud plate 122 that extends radially from a first surface 124 to a second surface 126. In the exemplary embodiment, each of first surface 124 and second surface 126 is generally planar. In alternative embodiments, at least one of first surface 124 and second surface 126 is non-planar.

First surface 124 of shroud plate 122 is coupled to tip end 114 of airfoil portion 110. More specifically, in the exemplary embodiment, first surface 124 is coupled to pressure side 102 proximate tip end 114 by a pressure side fillet 116, and to suction side 104 proximate tip end 114 by a suction side fillet 118. For example, but not by way of limitation, tip shroud 120 is coupled to airfoil portion 110 via welding, and pressure side fillet 116 and suction side fillet 118 are weld fillets. In alternative embodiments, tip shroud 120 is coupled to airfoil portion 110 in any suitable fashion that enables rotor blade 100 to function as described herein.

In the exemplary embodiment, a shroud rail 128 extends radially outward from second surface 126. In alternative embodiments, shroud rail 128 includes a plurality of shroud rails 128. In other alternative embodiments, tip shroud 120 does not include shroud rail 128.

A plurality of internal airfoil cooling passages 140 are defined in airfoil portion 110. In the exemplary embodiment, airfoil cooling passages 140 extend generally in radial direction 101 from root end 112 to tip end 114. In alternative embodiments, airfoil cooling passages 140 are defined in any suitable fashion that enables rotor blade 100 to function as described herein. In the exemplary embodiment, each airfoil cooling passage 140 has a substantially circular cross-section. In alternative embodiments, each airfoil cooling passage 140 has any suitable cross-section that enables airfoil cooling passage 140 to function as described herein. Each airfoil cooling passage 140 is suitably coupled in flow communication through root portion 130 with a suitable source of cooling fluid, such as, but not limited to, air provided from compressor section 14 (shown in FIG. 1).

In the exemplary embodiment, airfoil cooling passages 140 are disposed generally in series between leading edge 106 and trailing edge 108. More specifically, in the exemplary embodiment, airfoil portion 110 includes twelve airfoil cooling passages 140, including five airfoil cooling passages 140 disposed serially between leading edge 106 and shroud rail 128, and seven airfoil cooling passages 140 disposed serially between shroud rail 128 and trailing edge 108. In alternative embodiments, airfoil cooling passages 140 are disposed in any suitable fashion that enables rotor blade 100 to function as described herein.

A plurality of cavities 144 is defined in second surface 126 of shroud plate 122. Plurality of airfoil cooling passages 140 includes a first set 142 of airfoil cooling passages 140 that are each in flow communication with a respective one of plurality of cavities 144. In the exemplary embodiment, cooling fluid passing through first set 142 of airfoil cooling passages 140 and cavities 144 facilitates cooling of high thermal stress regions 132 of rotor blade 100, as will be described herein.

In the exemplary embodiment, plurality of airfoil cooling passages 140 also includes a second set 200 of airfoil cooling passages 140 that are each in flow communication with a respective one of a plurality of aligned openings 202 defined in shroud plate 122 and extending radially therethrough. More specifically, each airfoil cooling passage 140 in second set 200 is radially aligned with a respective opening 202, such that second set 200 of airfoil cooling passages 140 is configured to discharge cooling fluid radially outward from shroud plate 122 through aligned openings 202. In the exemplary embodiment, cooling fluid passing through second set 200 of airfoil cooling passages 140 facilitates cooling airfoil portion 110, and the cooling fluid then exits through aligned openings 202 to facilitate film and/or convection cooling of tip shroud 120. Additionally or alternatively, cooling fluid passing through first set 142 of airfoil cooling passages 140 and cavities 144 facilitates cooling airfoil portion 110 and film and/or convection cooling of tip shroud 120. In some alternative embodiments, plurality of airfoil cooling passages 140 does not include second set 200 of airfoil cooling passages 140, and shroud plate 122 does not include plurality of aligned openings 202.

Figure 5:
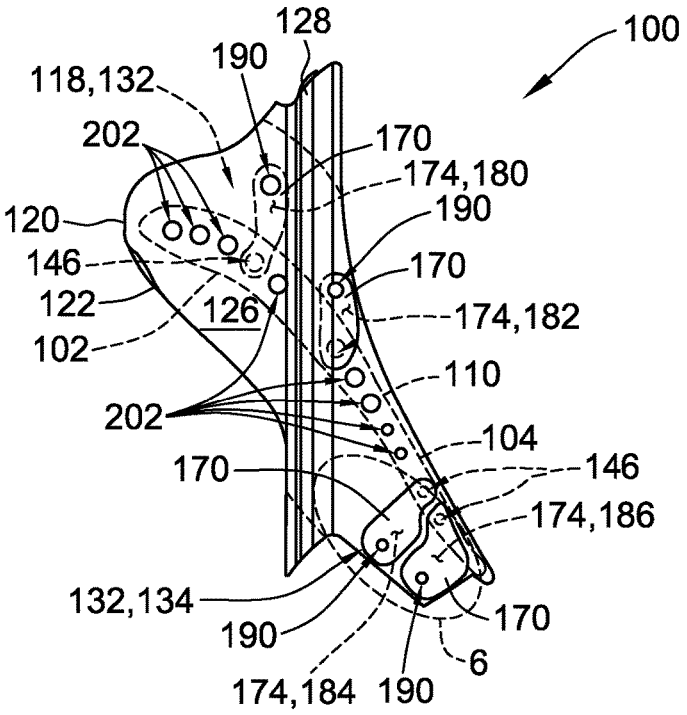
FIG. 5 is a schematic top view of the exemplary rotor blade shown in FIG. 2.
Figure 6:
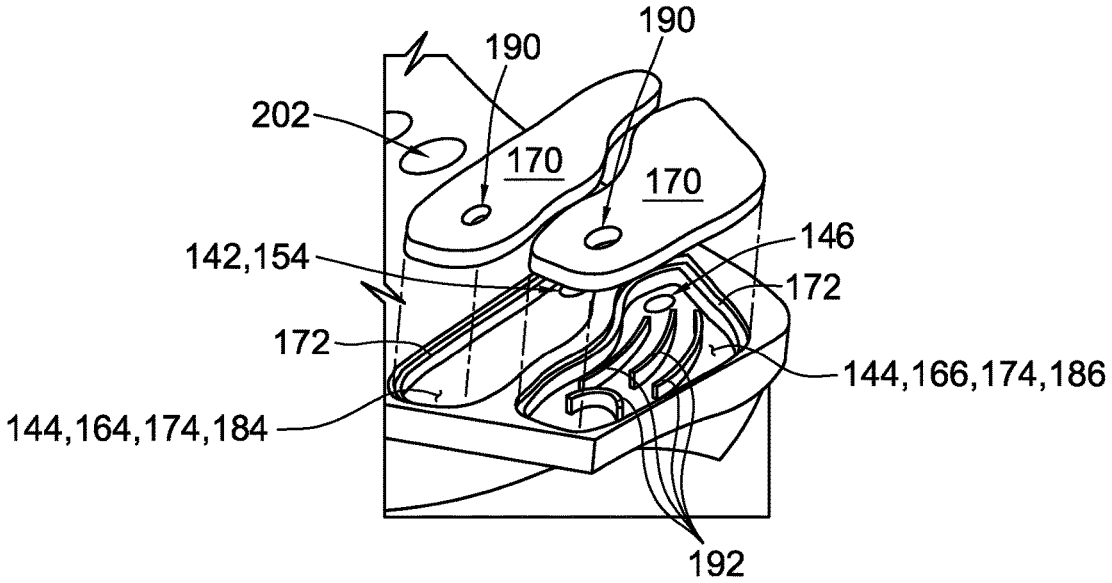
FIG. 6 is a schematic perspective exploded detail view of region 6 identified in FIG. 5.

FIG. 5 is a schematic top view of rotor blade 100, and FIG. 6 is a schematic perspective exploded detail view of region 6 identified in FIG. 5. With reference to FIGS. 2-6, in the exemplary embodiment, each cavity 144 is covered by a respective one of a plurality of cover plates 170 to form a respective one of a plurality of tip shroud cooling passages 174 defined within shroud plate 122. In alternative embodiments, each cavity 144 is covered in any suitable fashion to form the respective tip shroud cooling passage 174. In other alternative embodiments, tip shroud cooling passages 174 are defined between first surface 124 and second surface 126 such that second surface 126 is not breached by cavities 144, and no cover is needed to enclose tip shroud cooling passages 174.

In the exemplary embodiment, each tip shroud cooling passage 174 extends within shroud plate 122 in a direction generally transverse to radial direction 101. In alternative embodiments, each tip shroud cooling passage 174 extends within shroud plate 122 in any suitable direction that enables tip shroud cooling passages 174 to function as described herein. In the exemplary embodiment, each tip shroud cooling passage 174 is coupled in flow communication with a respective one of the first set 142 of airfoil cooling passages 140 at an inlet 146. Each inlet 146 is radially aligned with the respective one of the first set 142 of airfoil cooling passages 140 and, thus, lies within a cross-sectional profile of airfoil portion 110 proximate tip end 114. In alternative embodiments, each tip shroud cooling passage 174 is coupled in flow communication with at least one of airfoil cooling passages 140 in any suitable fashion.

In the exemplary embodiment, each cover plate 170 has a shape corresponding to a peripheral shape of the respective cavity 144. In alternative embodiments, each cover plate 170 has any suitable shape that enables tip shroud cooling passages 174 to function as described herein. In the exemplary embodiment, each cover plate 170 is seated on a recessed ridge 172 defined around the periphery of the respective cavity 144, such that cover plate 170 is flush with second surface 126. In alternative embodiments, each cover plate 170 is positioned over the corresponding cavity 144 in any suitable fashion and/or is other than flush with second surface 126. In the exemplary embodiment, each cover plate 170 is coupled to tip shroud 120 by one of welding and brazing. In alternative embodiments, each cover plate 170 is coupled to tip shroud 120 in any suitable fashion.

In certain embodiments, each cavity 144, and thus each tip shroud cooling passage 174, is defined within shroud plate 122 proximate a selected high thermal stress region 132 of rotor blade 100. In alternative embodiments, each respective cavity 144, and thus each tip shroud cooling passage 174, is defined within shroud plate 122 in any suitable location that enables rotor blade 100 to function as described herein.

For example, in certain embodiments, high thermal stress regions 132 of rotor blade 100 during operation of rotary machine 10 (shown in FIG. 1) include a pressure side aft overhang portion 134 of tip shroud 120, and also suction side fillet 118. In the exemplary embodiment, first set 142 of airfoil cooling passages 140 includes a first airfoil cooling passage 150 in flow communication with a first cavity 160 of plurality of cavities 144, a second airfoil cooling passage 152 in flow communication with a second cavity 162, a third airfoil cooling passage 154 in flow communication with a third cavity 164, and a fourth airfoil cooling passage 156 in flow communication with a fourth cavity 166. In addition, first cavity 160 and a corresponding cover plate 170 cooperate to define a first tip shroud cooling passage 180 of the plurality of tip shroud cooling passages 174, second cavity 162 and a corresponding cover plate 170 cooperate to define a second tip shroud cooling passage 182, third cavity 164 and a corresponding cover plate 170 cooperate to define a third tip shroud cooling passage 184, and fourth cavity 166 and a corresponding cover plate 170 cooperate to define a fourth tip shroud cooling passage 186. First tip shroud cooling passage 180 and second tip shroud cooling passage 182 each are defined proximate suction side fillet 118, and third tip shroud cooling passage 184 and fourth tip shroud cooling passage 186 each are defined proximate pressure side aft overhang portion 134. Thus, plurality of tip shroud cooling passages 174 facilitates providing cooling directly to high thermal stress regions 132 internally within rotor blade 100. Additionally or alternatively, rotor blade 100 includes tip shroud cooling passages 174 positioned proximate thermal stress regions other than pressure side aft overhang portion 134 and suction side fillet 118.

Each of the first set 142 of airfoil cooling passages 140 has a respective width 158. In certain embodiments, respective width 158 of each of the first set 142 of airfoil cooling passages 140 is selected to provide a corresponding flow rate of cooling fluid to the respective cavity 144, such that the relative flow rate of cooling fluid to each high thermal stress region 132 is tailored through the selection of width 158. For example, in the exemplary embodiment, suction side fillet 118 requires relatively more cooling than pressure side aft overhang portion 134, and widths 158 of first airfoil cooling passage 150 and second airfoil cooling passage 152, which supply cooling fluid respectively to first tip shroud cooling passage 180 and second tip shroud cooling passage 182 proximate suction side fillet 118, are greater than widths 158 of third airfoil cooling passage 154 and fourth airfoil cooling passage 156, which supply cooling fluid respectively to third tip shroud cooling passage 184 and fourth tip shroud cooling passage 186 proximate pressure side aft overhang portion 134. Moreover, in some embodiments, selection of each respective width 158 enables a relatively high flow rate of cooling fluid to each high thermal stress region 132 without a corresponding increase in a flow rate of cooling fluid through the second set 200 of airfoil cooling passages 140. Thus, first set 142 of airfoil cooling passages 140 each in flow communication with a respective one of plurality of tip shroud cooling passages 174 facilitates supplying a relatively larger amount of cooling fluid solely to high thermal stress regions 132 of rotor blade 100.

A plurality of exit openings 190 is defined in a radially outer surface of tip shroud 120, such that each exit opening 190 is in flow communication with a respective tip shroud cooling passage 174. In the exemplary embodiment, each exit opening 190 is defined in, and extends radially therethrough, a respective cover plate 170 that at least partially defines a radially outer surface of tip shroud 120. In alternative embodiments, at least one exit opening 190 is defined in, and extends radially therethrough, radially outer second surface 126 of shroud plate 122. In other alternative embodiments, each exit opening is defined in any suitable location and orientation that enables tip shroud cooling passages 174 to function as described herein. In the exemplary embodiment, each exit opening 190 has a substantially circular shape. In alternative embodiments, each exit opening 190 has any suitable shape that enables airfoil cooling passage 140 to function as described herein.

In the exemplary embodiment, each exit opening 190 is offset in a direction transverse to radial direction 101 from the corresponding inlet 146 associated with the respective tip shroud cooling passage 174. In other words, exit openings 190 are not radially aligned with the corresponding airfoil cooling passages 140. Moreover, in certain embodiments, each exit opening 190 is defined outside a cross-sectional profile of airfoil portion 110 proximate tip end 114. For example, in the exemplary embodiment, exit openings 190 associated with first tip shroud cooling passage 180 and second tip shroud cooling passage 182 are offset from first airfoil cooling passage 150 and second airfoil cooling passage 152, respectively, generally toward suction side fillet 118, and exit openings 190 associated with third tip shroud cooling passage 184 and fourth tip shroud cooling passage 186 are offset from third airfoil cooling passage 154 and fourth airfoil cooling passage 156, respectively, generally toward pressure side aft overhang portion 134. In some embodiments, exit openings 190 being offset from inlets 146 facilitates increased circulation of the cooling fluid within tip shroud cooling passages 174 in directions generally transverse to radial direction 101 and, therefore, increased cooling of high thermal stress regions 132. In alternative embodiments, at least one exit opening 190 is radially aligned with the corresponding inlet 146 of the respective tip shroud cooling passage 174.

In operation of the exemplary embodiment, cooling fluid enters each of the first set 142 of airfoil cooling passages 140 through root portion 130 of rotor blade 100 and flows radially outward through each of the first set 142 of airfoil cooling passages 140 and through inlet 146 into the corresponding tip shroud cooling passage 174. The cooling fluid then circulates in directions generally transverse to radial direction 101 within each tip shroud cooling passage 174, and exits rotor blade 100 radially through the corresponding exit opening 190. In other words, each airfoil cooling passage 140 of the first set 142 of airfoil cooling passages 140 cooperates with one of tip shroud cooling passages 174 and one of exit openings 190 in one-to-one correspondence to form a respective cooling flow path. In certain embodiments, the cooling fluid exiting radially through exit openings 190 further facilitates film and/or convection cooling of second surface 126 of shroud plate 122, as well as shroud plates 122 of adjacent rotor blades in turbine section 18 (shown in FIG. 1).

In some embodiments, at least one vane 192 is disposed within at least one tip shroud cooling passage 174. For example, in the exemplary embodiment, four vanes 192 are disposed within fourth tip shroud cooling passage 186. In alternative embodiments, any suitable number of vanes 192 is disposed within the at least one tip shroud cooling passage 174. In the exemplary embodiment, vanes 192 are contoured to guide the flow of cooling fluid in tip shroud cooling passages 174 such that cooling of the associated high thermal stress region 132 is increased, as compared to a similar tip shroud cooling passage not having vanes 192. Additionally or alternatively, vanes 192 are configured to provide structural support to the associated cover plate 170.

In the exemplary embodiment, each vane 192 is coupled to shroud plate 122 within the corresponding cavity 144 and extends radially outward. In alternative embodiments, at least one vane 192 is coupled to the corresponding cover plate 170 and extends radially inward. In other alternative embodiments, tip shroud cooling passages 174 do not include vanes 192.

In certain embodiments, a cooling provided by tip shroud cooling passages 174 to at least one high thermal stress region 132 enables rotor blade 100 to include tip shroud 120 having less scallop, as compared to a similar rotor blade that does not include tip shroud cooling passages 174. For example, in the exemplary embodiment, as compared to rotor blade 100 without third tip shroud cooling passage 184 and fourth tip shroud cooling passage 186, an additional cooling provided to pressure side aft overhang portion 134 by third tip shroud cooling passage 184 and fourth tip shroud cooling passage 186 enables shroud plate 122 to extend further outward, in a direction generally perpendicular to pressure side 102, while still maintaining pressure side aft overhang portion 134 within an acceptable temperature range. In some embodiments, a reduced scallop of tip shroud 120 improves an aerodynamic effectiveness of tip shroud 120 and, thus, an efficiency of rotary machine 10.

Figure 7:
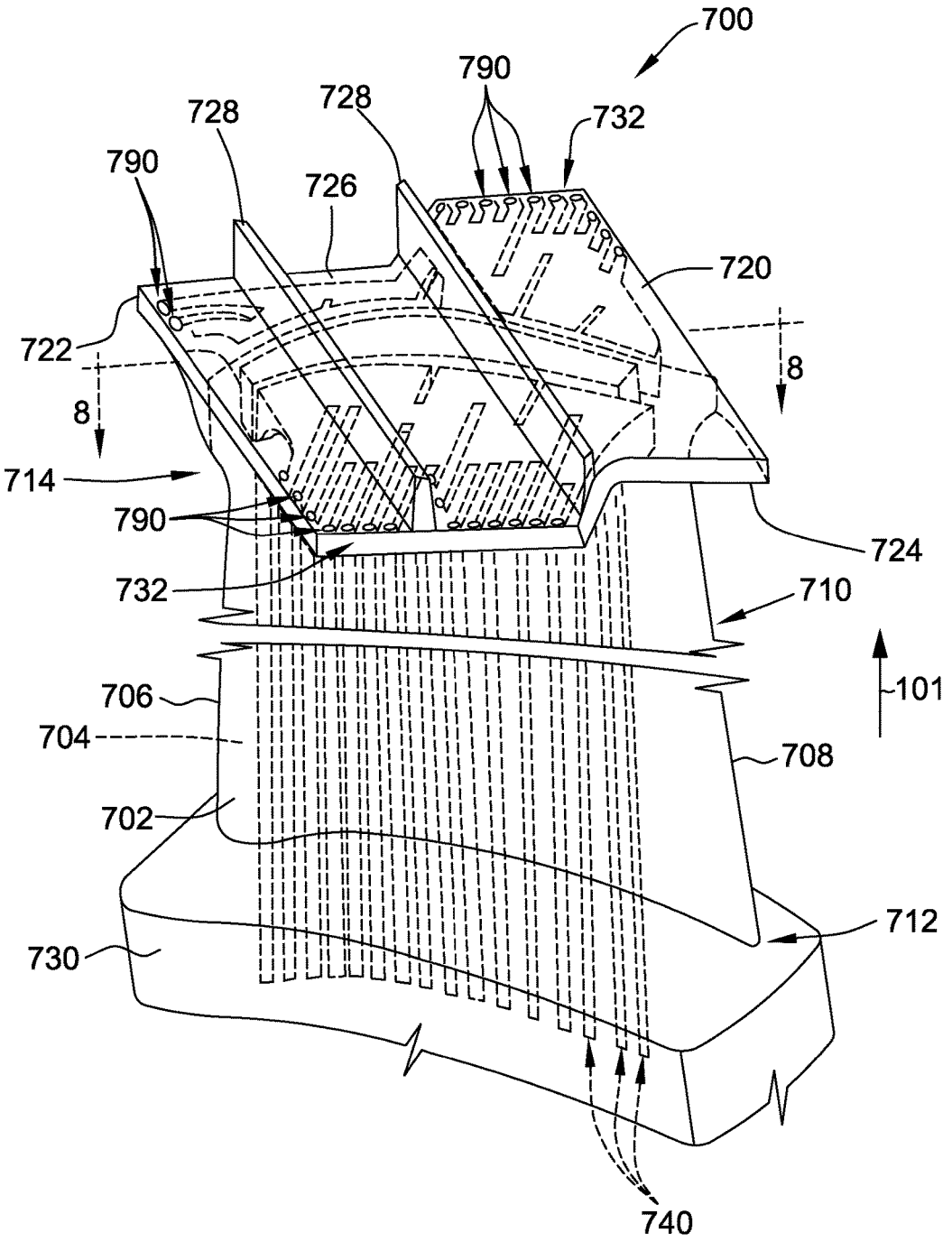
FIG. 7 is a schematic perspective view of another exemplary rotor blade for use with a rotary machine, such as the exemplary rotary machine shown in FIG. 1.
Figure 8:
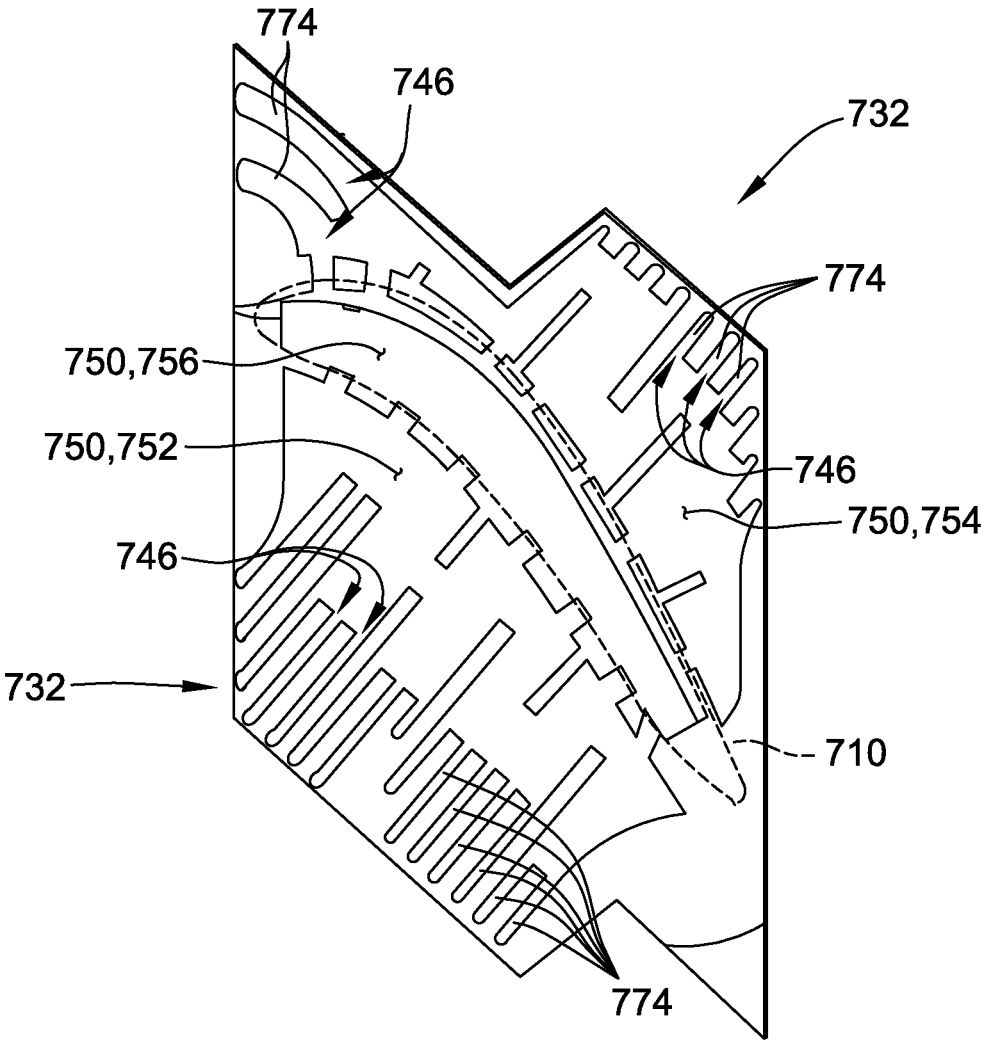
FIG. 8 is a schematic cross-section of an exemplary tip shroud of the rotor blade shown in FIG. 7, taken along lines 8-8 shown in FIG. 7.

FIG. 7 is a schematic perspective view of another exemplary rotor blade 700 for use with rotary machine 10. FIG. 8 is a schematic cross-section of a tip shroud 720 of rotor blade 700 taken along lines 8-8 shown in FIG. 7. For example, rotor blade 700 is used as one of rotor blades 70 (shown in FIG. 1).

With reference to FIGS. 7 and 8, in the exemplary embodiment, similar to rotor blade 100 described above (shown in FIG. 2), rotor blade 700 includes an airfoil portion 710, a tip shroud 720, and a root portion 730. Airfoil portion 710 extends from a pressure side 702 to an opposite suction side 704, each of pressure side 702 and suction side 704 extends from a leading edge 706 to an opposite trailing edge 708, and airfoil portion 710 extends generally in radial direction 101 from a root end 712 to an opposite tip end 714. Root end 712 of airfoil portion 710 is coupled to root portion 730. Root portion 730 includes any suitable structure that enables rotor blade 700 to couple to rotor 22 (shown in FIG. 1), such as, but not limited to, a dovetail (not shown). In alternative embodiments, rotor blade 700 has any suitable configuration that is capable of being formed with tip shroud 720 as described herein.

Also similar to rotor blade 100, tip shroud 720 includes a shroud plate 722 that extends radially from a first surface 724 to a second surface 726, and first surface 724 is coupled to tip end 714 of airfoil portion 710 in a suitable fashion. In the exemplary embodiment, a pair of shroud rails 728 extends radially outward from second surface 726. In alternative embodiments, any suitable number of shroud rails 728 extends radially outward from second surface 726. For example, in some alternative embodiments, tip shroud 720 does not include any shroud rails 728.

A plurality of internal airfoil cooling passages 740 are defined within airfoil portion 710. In the exemplary embodiment, airfoil cooling passages 740 extend generally in radial direction 101 from root end 712 to tip end 714. In alternative embodiments, airfoil cooling passages 740 are defined in any suitable fashion that enables rotor blade 700 to function as described herein. In the exemplary embodiment, each airfoil cooling passage 740 has a substantially circular cross-section. In alternative embodiments, each airfoil cooling passage 740 has any suitable cross-section that enables airfoil cooling passage 740 to function as described herein. Each airfoil cooling passage 740 is suitably coupled in flow communication through root portion 730 with a suitable source of cooling fluid, such as, but not limited to, air provided from compressor section 14 (shown in FIG. 1). In the exemplary embodiment, airfoil cooling passages 740 are disposed generally in series between leading edge 706 and trailing edge 708. In alternative embodiments, airfoil cooling passages 740 are disposed in any suitable fashion that enables rotor blade 700 to function as described herein.

In the exemplary embodiment, at least one of airfoil cooling passages 740 is in flow communication with a cooling plenum 750 defined at least partially within tip shroud 720. In the exemplary embodiment, cooling plenum 750 includes a pressure side cooling plenum 752 and a suction side cooling plenum 754 defined, respectively, on pressure side 702 and suction side 704 of airfoil portion 710. In certain embodiments, pressure side cooling plenum 752 and suction side cooling plenum 754 are in fluid communication with each other via a central cooling plenum 756, and cooling fluid from each airfoil cooling passage 740 is received in central cooling plenum 756. In alternative embodiments, pressure side cooling plenum 752 and suction side cooling plenum 754 are not in direct fluid communication with each other, and each of pressure side cooling plenum 752 and suction side cooling plenum 754 is supplied with cooling fluid through respective separate sets of airfoil cooling passages 740.

A plurality of tip shroud cooling passages 774 is defined within shroud plate 722. In the exemplary embodiment, each tip shroud cooling passage 774 extends within shroud plate 722 in a direction generally transverse to radial direction 101. In alternative embodiments, each tip shroud cooling passage 774 extends within shroud plate 722 in any suitable direction that enables tip shroud cooling passages 774 to function as described herein.

Each tip shroud cooling passage 774 is coupled in flow communication with cooling plenum 750 at a respective inlet 746. In certain embodiments, each tip shroud cooling passage 774 is defined proximate a selected high thermal stress region 732 of rotor blade 700. In alternative embodiments, each tip shroud cooling passage 774 is defined within shroud plate 722 in any suitable location that enables rotor blade 700 to function as described herein.

A plurality of exit openings 790 is defined in a radially outer surface of tip shroud 720, such that each exit opening 790 is in flow communication with a respective tip shroud cooling passage 774. In the exemplary embodiment, each exit opening 790 is defined in, and extends radially therethrough, radially outer second surface 726 of shroud plate 722. In alternative embodiments, at least one exit opening 790 is defined in, and extends radially therethrough, a respective cover plate (not shown) that at least partially defines a radially outer surface of tip shroud 720. In other alternative embodiments, each exit opening 790 is defined in any suitable location and orientation that enables tip shroud cooling passages 774 to function as described herein. In the exemplary embodiment, each exit opening 790 has a substantially circular shape. In alternative embodiments, each exit opening 790 has any suitable shape that enables airfoil cooling passage 140 to function as described herein.

In the exemplary embodiment, each exit opening 790 is offset from the corresponding inlet 746 associated with the respective tip shroud cooling passage 774. Moreover, exit openings 790 are not radially aligned with airfoil cooling passages 740 and/or cooling plenum 750. Moreover, in certain embodiments, each exit opening 790 is defined outside a cross-sectional profile of airfoil portion 710 proximate tip end 714. For example, in the exemplary embodiment, exit openings 790 are offset from cooling plenum 750 generally toward a suction side periphery and a pressure side periphery of shroud plate 722. In some embodiments, exit openings 790 being offset from inlets 746 facilitates increased circulation of the cooling fluid in tip shroud cooling passages 774 in directions generally transverse to radial direction 101 and, therefore, increased cooling of high thermal stress regions 732. In alternative embodiments, at least one exit opening 790 is radially aligned with the corresponding inlet 746 of the respective tip shroud cooling passage 774.

In operation in the exemplary embodiment, cooling fluid enters each of airfoil cooling passages 740 through root portion 730 of rotor blade 700 and flows radially outward through each of airfoil cooling passages 740 into cooling plenum 750. The cooling fluid flows from cooling plenum 750 through inlets 746 into tip shroud cooling passages 774.

The cooling fluid then circulates in directions generally transverse to radial direction 101 within each tip shroud cooling passage 774, and exits rotor blade 700 radially through the corresponding exit opening 790. In certain embodiments, the cooling fluid exiting radially through exit openings 790 further facilitates film and/or convection cooling of second surface 726 of shroud plate 722, as well as shroud plates 722 of adjacent rotor blades in turbine section 18 (shown in FIG. 1).

Figure 9:
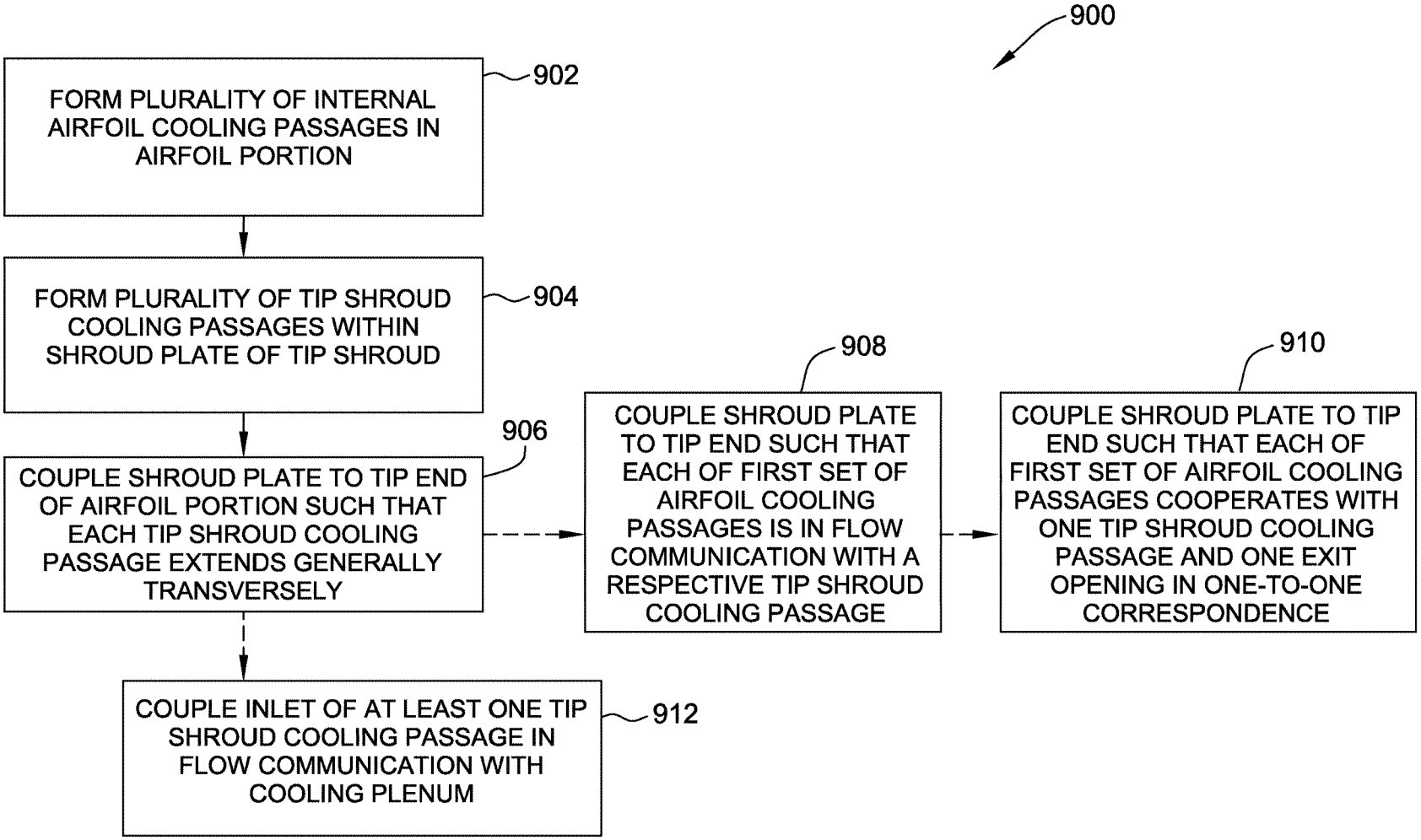
FIG. 9 is a flow diagram of an exemplary embodiment of a method forming a rotor blade, such as the exemplary rotor blade shown in FIGS. 2-6 or the exemplary rotor blade shown in FIGS. 7 and 8.

An exemplary embodiment of a method 900 of forming a rotor blade, such as rotor blade 100 or rotor blade 700, is illustrated in a flow diagram in FIG. 9. With reference also to FIGS. 1-8, exemplary method 900 includes forming 902 a plurality of internal airfoil cooling passages, such as airfoil cooling passages 140 or 740, in an airfoil portion, such as airfoil portion 110 or 710. The airfoil portion extends in a radial direction, such as radial direction 101, from a root end to a tip end, such as root end 112 or 712 and tip end 114 or 714. Method 900 also includes forming 904 a plurality of tip shroud cooling passages, such as tip shroud cooling passages 174 or 774, within a shroud plate of a tip shroud, such as shroud plate 122 of tip shroud 120 or shroud plate 722 of tip shroud 720. Method 900 further includes coupling 906 the shroud plate to the tip end of the airfoil portion such that each of the tip shroud cooling passages extends within the shroud plate in a direction generally transverse to the radial direction. Each tip shroud passage includes an inlet, such as inlet 146 or 746, coupled in flow communication with at least one of the airfoil cooling passages, and an exit opening, such as exit opening 190 or 790, defined in, and extending therethrough, a radially outer surface of the tip shroud, such as second surface 126 or 726 or cover plate 170. The exit opening is coupled in flow communication with the inlet.

In certain embodiments, the plurality of airfoil cooling passages includes a first set of airfoil cooling passages, such as first set 142 of airfoil cooling passages 140, and the step of coupling 906 the shroud plate to the tip end further includes coupling 908 the shroud plate to the tip end such that each of the first set of airfoil cooling passages is in flow communication with a respective one of the tip shroud cooling passages. In some such embodiments, the step of coupling 906 the shroud plate to the tip end further includes coupling 910 the shroud plate to the tip end such that each of the first set of airfoil cooling passages cooperates with one of the tip shroud cooling passages and one of the exit openings in one-to-one correspondence to form a respective cooling flow path.

In some embodiments, at least one of the airfoil cooling passages is in flow communication with a cooling plenum defined at least partially within the tip shroud, such as cooling plenum 750, and method 900 further includes coupling 912 the inlet of at least one of the tip shroud cooling passages in flow communication with the cooling plenum.

Exemplary embodiments of a rotor blade having tip shroud cooling passages, and a method of forming such a rotor blade, are described above in detail. The embodiments described herein provide an advantage over known rotor blades in that one or more of the tip shroud cooling passages are placed adjacent regions of high thermal stress on or near the tip shroud, and also are provided with radial exit openings that exhaust the cooling fluid over a radially outer surface of the tip shroud. Thus, the embodiments described herein facilitate supplying a relatively larger amount of cooling fluid selectively and precisely to high thermal stress regions of the rotor blade on or near the tip shroud, while also facilitating film and/or convection cooling of the surface of the tip shroud. Certain embodiments provide an additional advantage in that each tip shroud cooling passage is coupled to a respective airfoil cooling passage in one-to-one correspondence, and a width of each respective airfoil cooling passage is selected to facilitate an increased cooling fluid supply to the corresponding tip shroud cooling passage without requiring increased general cooling fluid supply to all tip shroud cooling passages. Some embodiments provide a further advantage in that at least one tip shroud cooling passage is defined by a cavity formed in a surface of a shroud plate and covered with a cover plate, facilitating ease of manufacture of the tip shroud. In some such embodiments, the radial exit opening is defined in the cover plate, further facilitating ease of manufacture of the tip shroud.

The methods, apparatus, and systems described herein are not limited to the specific embodiments described herein. For example, components of each apparatus or system and/or steps of each method may be used and/or practiced independently and separately from other components and/or steps described herein. In addition, each component and/or step may also be used and/or practiced with other assemblies and methods.

While the disclosure has been described in terms of various specific embodiments, those skilled in the art will recognize that the disclosure can be practiced with modification within the spirit and scope of the claims. Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

What is claimed is:

1. A rotor blade comprising:

an airfoil portion that extends from a pressure side to a suction side, and extends in a radial direction from a root end to a tip end, a plurality of internal airfoil cooling passages defined in said airfoil portion;

a tip shroud extending radially outward from a first surface to a second surface, said first surface coupled to said tip end, said tip shroud comprising an aft overhang portion extending aftward beyond said pressure side of said airfoil portion, a plurality of tip shroud cooling passages defined within said tip shroud, each of said tip shroud cooling passages extends within said tip shroud in a direction generally transverse to the radial direction, each said tip shroud cooling passage comprising:

an inlet coupled in flow communication with a respective single one of said airfoil cooling passages; and an exit opening defined in, and extending therethrough, said second surface of said aft overhang portion of said tip shroud, said exit opening coupled in flow communication with said inlet; and wherein said tip shroud further comprises a shroud plate and a plurality of cover plates coupled to said shroud plate, each of said cover plates covers a respective one of said a plurality of cavities depending into said shroud plate to define a respective one of said tip shroud cooling passages.

2. The rotor blade of claim 1, wherein said inlet is radially aligned with an outlet of said respective single airfoil cooling passage.

3. The rotor blade of claim 2, wherein said plurality of airfoil cooling passages comprises a first set of airfoil cooling passages and a second set of said airfoil cooling passages, wherein said first set of airfoil cooling passages consists of each of said respective single ones of said airfoil cooling passages, each of said second set of said airfoil cooling passages is in flow communication with a respective one of a plurality of radially aligned openings defined in said tip shroud and extending radially therethrough.

4. The rotor blade of claim 1, wherein each of said respective single ones of said airfoil cooling passages cooperates with a corresponding one of said exit openings in one-to-one correspondence to form a respective cooling flow path.

5. The rotor blade of claim 1, wherein said exit opening is defined in said cover plate.

6. The rotor blade of claim 1, wherein said exit opening of at least one of said tip shroud cooling passages is offset from said inlet of said at least one tip shroud cooling passage in a direction transverse to the radial direction.

7. The rotor blade of claim 1, wherein each of said cover plates extends at least partially over said aft overhang portion.

8. A rotary machine comprising:

a turbine section comprising a plurality of rotor blades, wherein at least one of said rotor blades comprises:

an airfoil portion that extends from a pressure side to a suction side, and extends in a radial direction from a root end to a tip end, a plurality of internal airfoil cooling passages defined in said airfoil portion; and a tip shroud comprising:

a shroud plate extending radially outward from a first surface to a second surface, said first surface coupled to said tip end, said shroud plate comprising an aft overhang portion extending aftward beyond said pressure side of said airfoil portion, wherein a plurality of cavities are defined in said second surface; and a plurality of cover plates coupled to said second surface, each of said cover plates covers a respective one of said cavities in one-to-one correspondence to define a corresponding one of a plurality of tip shroud cooling passages, each of said cover plates extends across said shroud plate in a direction generally transverse to the radial direction over said aft overhang portion, wherein each of said tip shroud passages comprises an inlet coupled in flow communication with one of said airfoil cooling passages and an exit opening defined in, and extending therethrough, a corresponding one of said cover plates.

9. The rotary machine of claim 8, wherein said inlet is radially aligned with an outlet of said one of said airfoil cooling passages.

10. The rotary machine of claim 9, wherein said plurality of airfoil cooling passages comprises a first set of airfoil cooling passages and a second set of said airfoil cooling passages, wherein each of said first set of airfoil cooling passages is coupled to said inlet of a respective single one of said tip shroud cooling passages, and wherein each of said second set of said airfoil cooling passages is in flow communication with a respective one of a plurality of radially aligned openings defined in said shroud plate and extending radially therethrough.

11. The rotary machine of claim 10, wherein each of said first set of airfoil cooling passages cooperates with a respective one of said exit openings in one-to-one correspondence to form a respective cooling flow path.

12. The rotary machine of claim 8, wherein said tip shroud further comprises one or more vanes positioned in at least one of said cavities, said one or more vanes configured to guide a flow of cooling fluid in said at least one of said cavities.

13. The rotary machine of claim 8, wherein said exit opening of at least one of said tip shroud cooling passages is offset from said inlet of said at least one tip shroud cooling passage in a direction transverse to the radial direction.

14. The rotary machine of claim 13, wherein said exit opening of said at least one tip shroud cooling passage is located on said aft overhang portion.

15. A method of forming a rotor blade, said method comprising:

forming a plurality of internal airfoil cooling passages in an airfoil portion, wherein the airfoil portion extends from a pressure side to a suction side, and extends in a radial direction from a root end to a tip end;

coupling a first surface of a shroud plate to the tip end of the airfoil portion wherein the shroud plate further includes a second surface radially outward from, and opposite to, the first surface and an aft overhang portion extending aftward beyond the pressure side of the airfoil portion, and wherein the second surface includes a plurality of cavities defined therein;

coupling a plurality of cover plates to the second surface such that each of the cover plates (i) extends over the aft overhang portion, and (ii) covers a respective one of the cavities in one-to-one correspondence to define a corresponding one of a plurality of tip shroud cooling passages that extends within the shroud plate in a direction generally transverse to the radial direction, wherein each tip shroud passage includes:

an inlet coupled in flow communication with one of the airfoil cooling passages; and an exit opening defined in, and extending therethrough, the respective cover plate.

16. The method of claim 15, wherein said coupling the shroud plate to the tip end further comprises coupling the shroud plate to the tip end such that the inlet of each of the tip shroud cooling passages is radially aligned with an outlet of the respective one of the airfoil cooling passages.

17. The method of claim 16, wherein said coupling the plurality of cover plates to the second surface comprises coupling the plurality of cover plates such that the exit opening of at least one of the tip shroud cooling passages is offset from the inlet of the at least one tip shroud cooling passage in a direction transverse to the radial direction.

18. The method of claim 15, wherein said coupling the plurality of cover plates to the second surface comprises coupling the plurality of cover plates such that the exit opening of at least one of the tip shroud cooling passages is located on the aft overhang portion.

* * * * *